US005803672A

United States Patent [19]

Glass et al.

[11] Patent Number: 5,803,672

[45] Date of Patent: Sep. 8, 1998

[54] METHOD AND APPARATUS FOR INSERTING SHEET PILES UTILIZING A PROTECTIVE HOUSING

[75] Inventors: James O. Glass; Sam M. Glass, both of Anahuac, Tex.

[73] Assignee: Stab Cat, Inc., Anahuac, Tex.

[21] Appl. No.: 773,209

[22] Filed: Dec. 23, 1996

[51] Int. Cl.[6] ..... E02D 5/02

[52] U.S. Cl. ..... 405/274; 405/50; 405/232; 405/267; 29/252

[58] Field of Search ..... 405/50, 230, 232, 405/243, 267, 274, 275, 276, 277, 278, 279, 280, 281; 29/252

[56] References Cited

U.S. PATENT DOCUMENTS

| | | | |
|---|---|---|---|
| 3,019,608 | 2/1962 | Marmion | 405/232 |
| 3,866,425 | 2/1975 | Morrice | 405/232 X |
| 4,094,156 | 6/1978 | Dumont | 405/274 |
| 4,664,560 | 5/1987 | Cortlever | 405/267 X |
| 5,012,873 | 5/1991 | Kennedy et al. | 405/50 X |
| 5,269,630 | 12/1993 | Bolin et al. | 405/230 |
| 5,503,503 | 4/1996 | Glass et al. | 405/274 |

FOREIGN PATENT DOCUMENTS

| | | | |
|---|---|---|---|
| 117325 | 6/1986 | Japan | 405/274 |
| 55335 | 3/1987 | Japan | 405/274 |

*Primary Examiner*—David J. Bagnell
*Assistant Examiner*—Jong-Suk Lee
*Attorney, Agent, or Firm*—Bush, Riddle & Jackson

[57] ABSTRACT

A protective housing (12) is provided for a sheet pile (10) and has a length extending beyond the upper end (10A) and lower end (10B) of the sheet pile (10). A separate force transmitting member (26) is mounted on the protective housing (12) and has a horizontal plate (28) engaging the upper end (10A) of the sheet pile (10) for driving the sheet pile (10) downwardly upon exertion of a downward force from a suitable power source (44) to force the protective housing (12) downwardly. To separate protective housing (12) from sheet pile (10) upon driving of the sheet pile (10) to a desired predetermined depth so that protective housing (12) may be withdrawn, a fluid pressure device (50) is mounted between protective housing (12) and the force transmitting member (26). Upon actuation of fluid pressure device (50), protective housing (12) is moved upwardly while sheet pile (10) remains in position thereby to initially break loose the protective housing (12). After the initial separation of protective housing (12) the protective housing (12) along with the force transmitting member (26) may be lifted upwardly for removal by a suitable overhead lift means such as a crane.

7 Claims, 2 Drawing Sheets

METHOD AND APPARATUS FOR INSERTING SHEET PILES UTILIZING A PROTECTIVE HOUSING

FIELD OF THE INVENTION

This invention relates to a method and apparatus for inserting sheet pile within an earth formation utilizing a separate protective housing or shield, and more particularly to such an apparatus and method permitting easy withdrawal of the protective housing after driving of the sheet pile to a desired depth in the formation.

BACKGROUND OF THE INVENTION

Sheet piles when driven in an earth formation, particularly if the pile is formed of a non-metallic material or a relatively thin metal material such as aluminum, may become damaged when driven into the ground. Sheet piles or piling for certain uses such as sea walls, for example, may be formed of inter-locking piling extruded from special vinyl formulations. Sheet piles formed of a rigid vinyl material are resistant to marine bores, rot, rust, galvanic corrosion, or highly acidic or alkaline soil conditions.

Heretofore, as shown in U.S. Pat. No. 5,503,503 dated Apr. 2, 1996, a protective housing or shield has been provided for protecting the sheet piling during driving or insertion of the sheet piling within the soil or earth formation. The protective housing or shield is preferably formed of metal having a cross section generally similar to the cross section of the sheet pile and adapted to be releasably connected to the sheet pile for simultaneous movement with the sheet pile. The protective housing is of a length greater than the length of the sheet piling and extends beyond the upper and lower ends of the sheet piling. The protective housing and connected sheet pile are driven downward into the formation together to a desired or predetermined depth. Then, the protective housing is lifted upwardly for removal or withdrawal leaving the sheet pile in place.

After insertion of the sheet pile at the desired depth in the formation, the protective housing or shield is removed by lifting of the protective housing vertically relative to the sheet pile. Oftentimes, the protective housing and sheet pile stick or adhere to each other and it may be difficult to break loose or separate initially the protective housing without some corresponding vertical movement of the sheet pile or possibly some damage to the sheet pile. It is desirable that the sheet pile remain fixed in place within any vertical movement while the protective housing is withdrawn and that the protective housing be easily separated initially from the sheet pile when removed.

It is an object of the present invention to provide an apparatus and method for separation of the protective housing from the sheet pile after the sheet pile has been driven to the desired depth while simultaneously holding the sheet pile in place.

SUMMARY OF THE INVENTION

The present invention is directed to a method and apparatus for permitting easy withdrawal of the protective housing after driving of the sheet pile to a desired depth in the formation by applying equal and opposed forces to the pile and protective house to break the protective house loose from the sheet pile while holding the sheet pile in place. The apparatus includes a force transmitting member separate from the sheet pile and the protective housing having a horizontal plate extending over and engaging the upper end of the sheet pile in driving relation. The plate also fits against the inner contour of the protective housing. Lugs or fingers secured to the protective housing extend laterally over the force transmitting member and engage the upper surface of the force transmitting member for pushing or driving the sheet pile downwardly into the formation.

For separating the protective housing and the sheet pile after the sheet pile has been driven to the predetermined desired depth, a fluid pressure means is mounted between the protective housing and the force transmitting member comprising a fluid cylinder pivotally connected to the force transmitting member and a piston rod pivotally connected to the protective housing. Upon energizing of the fluid pressure means, a downward force is exerted against the sheet pile to hold the sheet pile in place and an opposite upward force is exerted against the protective housing. Thus, the sheet pile is held down by the fluid pressure means while the protective housing is forced upwardly for vertically separating or breaking the housing loose from the sheet pile. After the protective housing has been broken loose from the sheet pile, the fluid pressure means may be deenergized and the protective housing together with the fluid pressure means and force transmitting device may be lifted upwardly by a suitable crane or the like to remove the protective housing.

Other features and advantages of the present invention will be apparent from the following specification and drawings.

DESCRIPTION OF THE INVENTION

Figure 3:
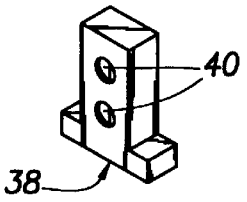
FIG. 3 is a perspective of a driving lug which is secured to the protective housing for contacting the force transmitting device.
Figure 1:
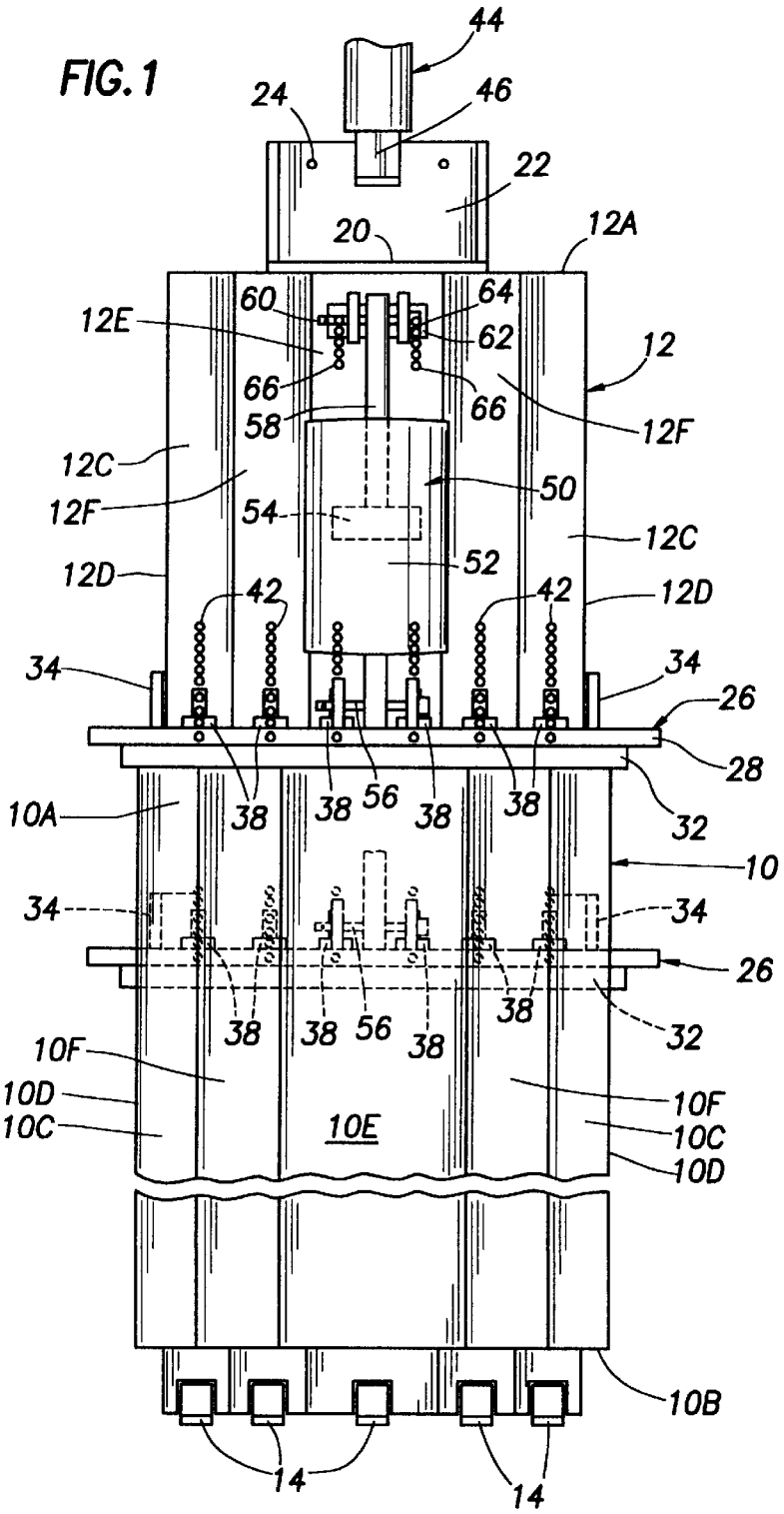
FIG. 1 is a perspective view of the apparatus of the present invention showing an outer protective housing and a separate force transmitting device for driving a sheet pile downward into a formation.
Figure 2:
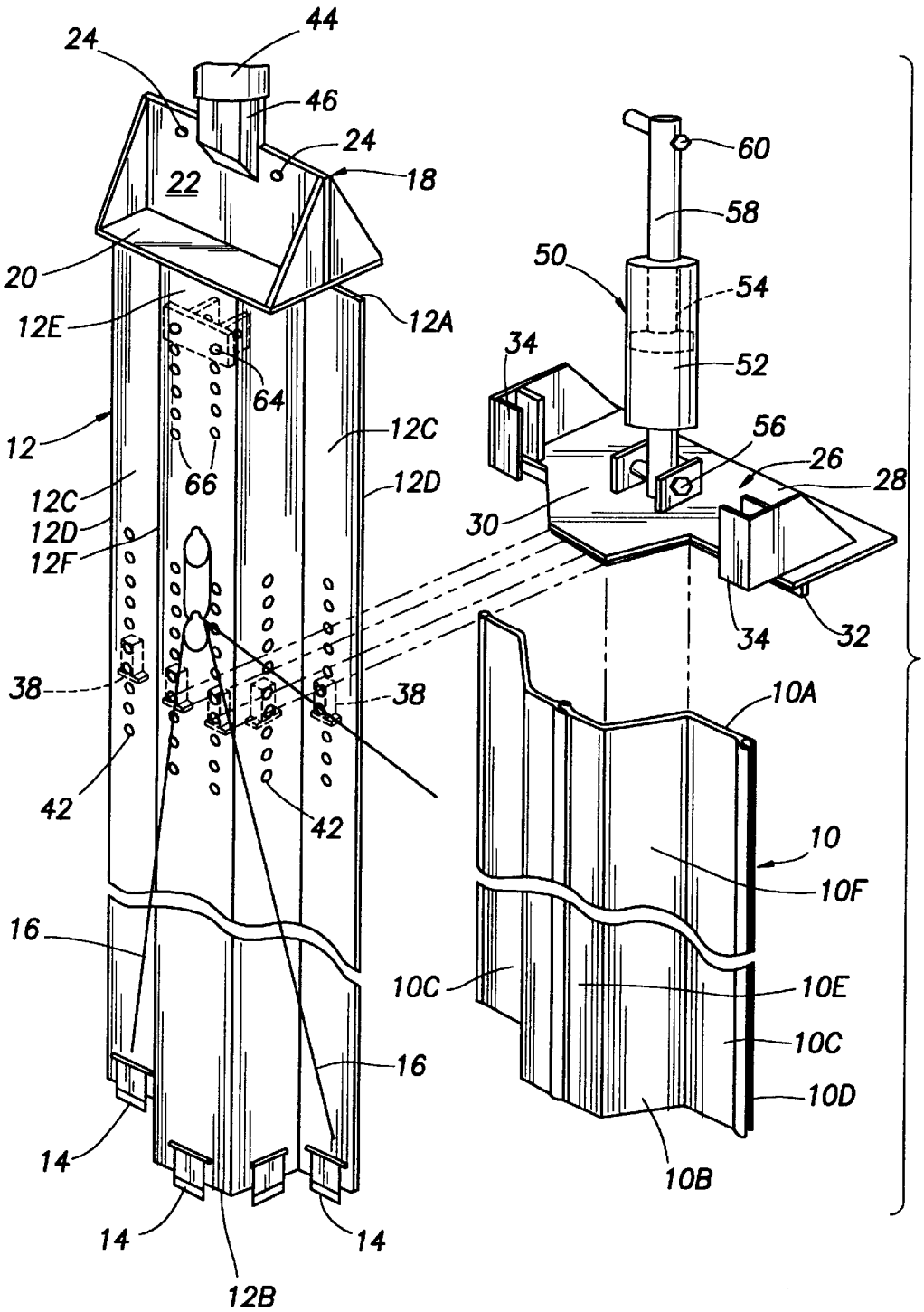
FIG. 2 is an exploded view of FIG. 1 showing the separate force transmitting device separated from the protective housing and sheet pile.

Referring now to the drawings for a better understanding of this invention, a sheet pile or piling generally indicating 10 has an upper end 10A, a lower end 10B, and side flanges 10C defining side edges 10D A central body 10E has connecting portions 10F extending to side flanges 10C. Sheet pile 10 may be formed of a rigid plastic material such as a rigid vinyl material.

A protective housing or shield generally indicated at 12 is preferably formed of metal having a cross section generally similar to the cross section of sheet pile 10 for positioning in a mating relation with sheet pile 10. Protective housing 12 is of a length greater than the length of sheet pile 10 and extends substantially beyond ends 10A and 10B of sheet pile 10. Protective housing 12 has an upper end 12A, a lower end 12B, and side flanges 12C defining side edges 12D. A central body portion is shown at 12E and integral connecting portions are shown at 12F between central body portion 12E and side flanges 12C. Lower end 12B has cutout portions for receiving fingers or flaps 14 which pivot upwardly about the lower end 10B of sheet pile 10 to retain sheet pile 10 for transport with protective housing 12 from one location to another location by a suitable overhead crane or the like, such as shown in aforementioned U.S. Pat. No. 5,503,503. Flaps 14 are pivoted about sheet pile 10 manually by actuation of a flexible cord 16. In some instances, it may be desirable to provide viselike clamps for holding sheet pile 10 and protective shield 12 together in lieu of flaps 14.

Secured such as by suitable welding to the upper edge 12A of protective housing 12 is an upper support bracket generally indicated at 18 including a lower horizontal plate 20 and a vertical plate 22. Suitable opening or eyes 24 are provided in plate 22 to receive safety hooks or the like on the ends of cables from a crane or other overhead lifting means.

A separate force transmitting device is shown generally at 26 and includes a horizontal plate 28 with a front edge 30 conforming generally to the cross section or shape of sheet pile 10 and protective housing 12. A downwardly extending lip 32 on plate 28 restrains sheet pile 10 against relative lateral movement. A pair of guides 34 secured to plate 28 receive flanges 12C of protective housing 12 and restrain lateral movement of force transmitting device 26 relative to protective housing 12. Force transmitting device 26 is adapted for seating on upper edge 10A of sheet pile 10.

To transfer driving force from protective housing 12 to force transmitting device 26, a plurality of laterally extending driving lugs or tabs 38 are provided having openings 40 therein. Lugs 38 are bolted to housing 12 at selective aligned openings 42 in housing 12. Lugs 38 engage the upper surface of plate 28 to push plate 28 and sheet pile 10 downwardly within the formation upon the exertion of force against plate 28 from protective housing 12. A vibrator hammer generally indicated at 44 is secured by suitable clamps or jaws 46 to plate 22 of bracket 18. The height of lugs 38 may be adjusted for the depth of sheet pile 10. Vibrator hammer 44 is connected to a suitable power source and is energized for moving protective housing 12 and lugs 38 downwardly against force transmitting device 26 for forcing sheet pile 10 downwardly within the formation to a desired depth.

For removing protective shield 12 after pile 10 reaches the desired depth, a fluid pressure device or means generally indicated at 50 is provided comprising a hydraulic cylinder 52 having a piston 54 mounted therein. A lower end of cylinder 52 is pivotally mounted to plate 28 about pivot 56. Piston rod 58 is mounted with pivot 60 to a clevis 62 secured to protective housing 12. Clevis 62 is secured by bolts 64 within selected openings 66 in body portion 12E of housing 12. Fluid pressure means 50 is deenergized during driving of sheet pile 10 into the formation. After driving sheet 10 to the desired depth into the formation, fluid pressure means 50 is energized to extend piston rod 58 for forcing protective housing 12 upwardly while holding sheet pile 10 downwardly thereby to break protective housing 12 loose from sheet pile 10.

For details concerning the operation of inserting sheet pile 10 within the formation utilizing protective housing 12, reference is made to U.S. Pat. No. 5,503,503 dated Apr. 2, 1996, the entire disclosure of which is incorporated by this reference. It is apparent that other types of force separation means may be provided between protective shield 12 and force transmitting member 26 for initially separating protective shield 12 from sheet pile 10 after driving of sheet pile 10 to a desired depth.

While the preferred embodiment of the present invention has been illustrated in detail, it is apparent that modifications and adaptations of the preferred embodiment will occur those skill in the art. However, it is to be expressly understood that such modifications and adaptations are in the spirit and scope of the present invention as set forth in the following claims.

What is claimed is:

1. A sheet pile installation apparatus for assisting the insertion of a sheet pile within an earth formation comprising:

an outer protective housing having a cross section generally similar to the cross section of the sheet pile for positioning in a generally vertical relation adjacent one side of said sheet pile for releasable connection to said sheet pile;

a separate force transmitting member for contacting the upper end of said pile in a driving relation to force said pile downwardly into the formation, said outer protective housing having means engaging said force transmitting member to force said force transmitting member downwardly for pushing said sheet pile within the formation; and separate force exerting means positioned between said force transmitting member and said protective housing to force said protective housing upwardly relative to said sheet pile and said force transmitting member upon positioning of said sheet pile at a predetermined depth in the formation.

2. The apparatus as set forth in claim 1 wherein said separate force exerting means comprises fluid pressure means connected between said force transmitting member and said protective housing actuated upon positioning of said sheet pile at a predetermined depth to provide an initial vertical movement of said protective housing relative to said sheet pile.

3. The apparatus as set forth in claim 1 wherein said outer protective housing includes a pair of side flanges and said force transmitting member has a pair of guides interfitting with said flanges to guide and maintain said force transmitting member in aligned position with the upper end of said sheet pile.

4. The apparatus as set forth in claim 1 wherein said outer protective housing includes a plurality of laterally projecting driving lugs for engaging the upper surface of said force transmitting member for pushing said sheet pile downwardly in the formation.

5. The apparatus as set forth in claim 1 wherein means are provided adjacent the lower end of said protective housing to permit transport of said protective housing and said sheet pile in mating relation from one location to another location.

6. A method of inserting a sheet pile within an earth formation utilizing a protective housing for the sheet pile; said method comprising the follow steps:

providing an outer protective housing having a cross section generally similar to the cross section of the sheet pile;

positioning said outer protective housing in mating relation to said sheet pile adjacent one side of said sheet pile for releasable connection to said sheet pile;

providing a separate force transmitting member engaging the upper end of said sheet pile mounted on said protective housing for relative sliding movement;

forcing said outer protective housing downwardly for engaging and forcing said separate force transmitting member downwardly together with said sheet pile until said sheet pile reaches a predetermined depth in the formation;

providing a separate force exerting means between said force transmitting member and said protective housing; and actuating said separate force exerting means upon positioning of said sheet pile at a predetermined depth to force said protective housing upwardly relative to said sheet pile and said force transmitting member for initially breaking said protective housing loose from said sheet pile.

7. The method as set forth in claim 6 further comprising the step of releasably connecting said protective housing and said sheet pile together for movement from one location to another location by a suitable overhead lift means.

* * * * *